US005556327A

United States Patent [19]

Jenkins et al.

[11] Patent Number: 5,556,327

[45] Date of Patent: Sep. 17, 1996

[54] APPARATUS AND METHODOLOGY FOR APPLYING FORCE TO A WORKPIECE

[76] Inventors: Gary Jenkins, 9 Granville Rd., Cambridge, Mass. 02138; Richard Mitrano, 106 Wildwood Rd., Andover, Mass. 01810; Curtis A. Vock, 28-A Federal St. #12, Salem, Mass. 01970

[21] Appl. No.: 322,606

[22] Filed: Oct. 13, 1994

[51] Int. Cl.[6] ..... B24B 7/00

[52] U.S. Cl. ..... 451/278; 451/259; 451/364; 451/548; 451/45; 269/8; 269/58

[58] Field of Search ..... 451/45, 48, 259, 451/260, 278, 285, 287, 288, 293, 364, 386, 391, 548; 269/8, 56, 58, 70, 317; 30/35

[56] References Cited

U.S. PATENT DOCUMENTS

| | | | |
|---|---|---|---|
| 2,953,851 | 9/1960 | Wheeler | 30/35 |
| 3,163,964 | 1/1965 | Wheeler | 451/278 |
| 3,932,967 | 1/1976 | Hanes | 451/45 |
| 3,935,638 | 2/1976 | Rookus | 30/37 |
| 4,271,635 | 6/1981 | Szalay | 451/259 |
| 4,299,063 | 11/1981 | Rookus | 51/241 S |
| 4,468,894 | 9/1984 | Hong | 451/293 |

*Primary Examiner*—D. S. Meislin
*Assistant Examiner*—Eileen P. Morgan
*Attorney, Agent, or Firm*—Curtis A. Vock

[57] ABSTRACT

The invention provides apparatus and methods for applying force to an object or workpiece. The invention has a first stationary magnet and second moveable magnet within a housing member. The magnets are arranged such that the magnets repel one another with a force related to the spacing between the magnets. The housing member is coupled to a modifying member, e.g., a motorized grinder or sharpener, with the object or workpiece disposed between the second magnet and the modifying member such that the second magnet forces the object or workpiece against the modifying element. The magnets can be electromagnets. In a preferred aspect, the object is a rotary razor head commonly used in electric razors and the invention sharpens the rotary razor head. In this aspect, the modifying member is a rotating grinding disc and anti-rotation elements prevent the razor head and magnets from rotating with the grinding element. The razor head is forced into the grinding element by the magnetic force formed by the two magnets.

6 Claims, 7 Drawing Sheets

APPARATUS AND METHODOLOGY FOR APPLYING FORCE TO A WORKPIECE

BACKGROUND

Electric razors are in wide use today. They typically include replaceable rotary-type razor heads which have a plurality of blades. These blades rotate underneath a circular screen that separates the blades from contact with the user. When the screen is pressed against a user's skin, the blades act to clip hair which extends between the screen openings, thereby "shaving" the person.

These electric razors are extremely useful and popular, often being portable and battery-powered. Their construction is so durable that they can last many years.

However, the rotary razor heads which are used with the razors do not have the same useful lifetime as the rest of the razor. The razor blades become dull and often need replacement. In certain instances, these razor heads need replacement several times in one year.

The replacement costs for the rotary heads are high, sometimes equaling the cost of the whole razor. Such costs tend to encourage users to buy new razors rather than just the replacement heads. This is both wasteful and expensive.

It is accordingly an object of this invention to provide apparatus and methods for sharpening rotary razor heads, thereby reducing both costs and waste.

Another object of the invention is to provide improved apparatus and methods for applying forces to objects, such as the blades on a rotary head razor.

These and other objects of the invention will be apparent in the description which follows.

SUMMARY OF THE INVENTION

As used herein, the term "object" or "workpiece" are used synonymously. They imply an object such as a razor head that can be sharpened or otherwise modified. The terms can also imply any type of workpiece that can be modified or that is forced against a modifying element, such as a grinding or sharpening element. Also as used herein, the term "support member" is used generically to imply a structure which can be coupled to the further features of the invention so that a force can be applied to the object or workpiece against, or relative to something. In other words, one object of the invention is to provide apparatus for applying force to an object. There must be something to connect to relative to the object in order to apply a force to the object; this is referred to as a "support member". For example, in one preferred aspect according to the invention, apparatus is provided to sharpen rotary razor heads used in electric razors. The rotary razor heads are forced against an abrasive element coupled to a motorized unit to sharpen the razor head. The motorized unit and abrasive element can be considered, in this instance, to be the "support member". Force is applied to the razor head by connecting to the motorized unit, i.e., the "support member", and pressing or forcing the razor head into the abrasive element.

The invention thus provides, in one aspect, apparatus for applying force to an object coupled to a support member. There is a first magnet and a second magnet arranged such that the second magnet is repelled from the first magnet in at least one direction. A housing member couples the two magnets together. The housing member fixedly engages the first magnet to the housing member and is arranged such that the second magnet slideably engages the housing member along the one direction. The housing member is connected to the support member such that the second magnet applies a force to the object.

In another aspect according to the invention, the first and second magnets are spaced apart along the one direction. A spacing element or assembly adjusts the spacing between the first and second magnets such that the force applied to the object is selectively modified by adjusting the spacing between the magnets.

In still another aspect, the first and second magnets are electromagnets. Preferably, therefore, the first and second magnets have an iron or steel (or mixtures of iron and steel) core and a solonoidal coil surrounding the core to form the electromagnet. In another preferred aspect, the invention provides a DC current supply electrically connected to the electromagnets to supply direct current selectively to the electromagnets. The DC current supply can selectively adjust the direct current to at least one of the magnets such that the force applied to the object is selectively modified by adjusting the direct current.

In another aspect according to the invention, the invention provides a modifying assembly or member for modifying the object as force is applied to the object. The modifying assembly is connected to the support member and disposed between the support member and the second magnet so that the object is forced against the modifying assembly by the second magnet. Preferably, the modifying assembly is a grinding element coupled to a motor driven shaft. The motor rotates the shaft and thereby rotates the grinding element so that the object forced against the grinding element is modified or ground. The grinding element is preferably a circular abrasive stone.

In another aspect, the motor rotates the workpiece directly while the grinding stone remains fixed relative to the workpiece. In still another aspect, both the workpiece and the grinding elements rotate in opposite directions and/or at different speeds to sharpen or grind the object.

The invention also provides, in yet another aspect, improved methods for applying force to a workpiece that is coupled to a support member, including the steps of: coupling the workpiece to a first magnet having opposed first and second surfaces and coupling the workpiece to the first surface, introducing a second magnet near to the second surface of the first magnet wherein a repelling force is created between the two magnets, and coupling the magnets and workpiece to the support member such that said force forces the workpiece into the support member.

In still another aspect, the invention provides a razor sharpener for sharpening a rotary razor head. A housing member holds a first magnet stationary within said housing member and slideably engages a second magnet such that the second magnet is repelled from the first magnet in at least one direction. Therefore, the second magnet slideably engages the housing member along the one direction. A motor assembly, having a motor and an abrasion element, is coupled to the housing member. The abrasion element is adjacent to the second magnet and the motor drives or rotates the abrasion element to sharpen a rotary razor head forced against the abrasion element. The second magnet is spaced apart from the abrasion element to accommodate the physical size of the rotary razor head therebetween such that the second magnet forces the rotary razor head against the abrasion element.

Preferably, the invention includes a first anti-rotation guide to prevent the rotation of the second magnet relative to the housing member. The anti-rotational guide preferably has a magnet holder with at least one anti-rotational pin member and at least one slot within the anti-rotational guide that accepts the pin member therethrough, thereby preventing the second magnet from rotating. In a preferred aspect, the magnet holder has at least one anti-rotation razor head pin extending away from the magnet holder such that the rotary razor head is prevented from rotation when forced into the abrasion element by the second magnet.

In another aspect, the invention includes an outside cap for enclosing the magnets and the anti-rotational guide.

The invention also includes, in one aspect, a rotary razor head having a plurality of blades. In this aspect, the abrasion element and the second magnet have sufficient size to accommodate the razor head such that said razor head is sharpened substantially equally when forced into the abrasion element by the second magnet.

The advantages of the invention are many. It saves cost and reduces waste. By utilizing magnets, the number of moving parts required to generate a force is reduced. Further, by changing the spacing between the magnets or by changing the current to an electromagnet, force applied to the object is changed incrementally and with great accuracy.

These and other advantages and aspects of the invention are evident in the description which follows and in the accompanying drawings.

DESCRIPTION OF ILLUSTRATED EMBODIMENTS

Figure 1:
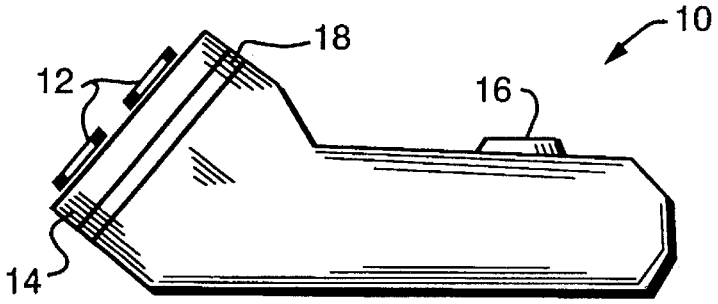
FIG. 1 is a schematic side view of a prior art electric razor.

FIG. 1 illustrates a typical prior art electric razor 10 having a body 11, head assemblies 12, a cap assembly 14, and a power switch 16. The cap assembly houses the head assemblies 12, each of which includes a non-rotating screen and a rotating razor head that has a plurality of blades. The cap assembly may be disconnected from the body 11 at the connection joint 18 so that a user can access and replace the rotating razor heads.

Figure 1A:
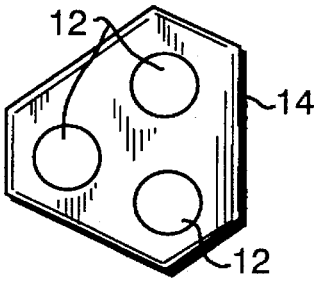
FIG. 1A is a top view of the razor cap assembly shown in FIG. 1.
Figure 1B:
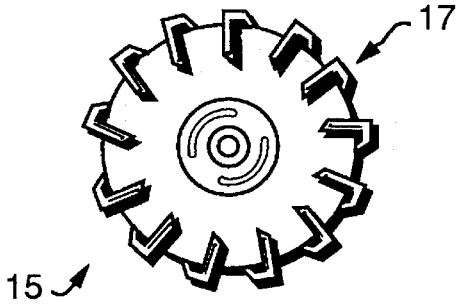
FIG. 1B is a top view of the rotating razor heads with a plurality of blades for use in the electric razor shown in FIG. 1.
Figure 1C:
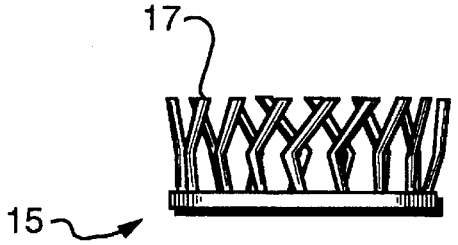
FIG. 1C is a side view of the rotating razor heads shown in FIG. 1B.

FIGS. 1A–1C show further features of the prior art razor 10 illustrated in FIG. 1. FIG. 1A shows a top view of the cap assembly 14 and a plurality of head assemblies 12. FIG. 1B shows a top view of the rotating razor head 15 with the plurality of blades 17 which are integral with the rotating razor head 15. The blades 17 rotate adjacent to the screen of the head assembly 12. FIG. 1C illustrates the rotating razor head 15 in a side view and shows that the blades 17 extend away from the rest of the rotating razor head 15.

In operation, a user presses the head assemblies 12 against the area to be shaved, e.g., a human face, and the rotating blades 17 cut hair which protrudes through the non-rotating screen.

This operation dulls the blades 17. The invention which is hereinafter described operates, in one aspect, to sharpen razor blades such as the blades 17 of the rotating razor head 15.

Figure 2:
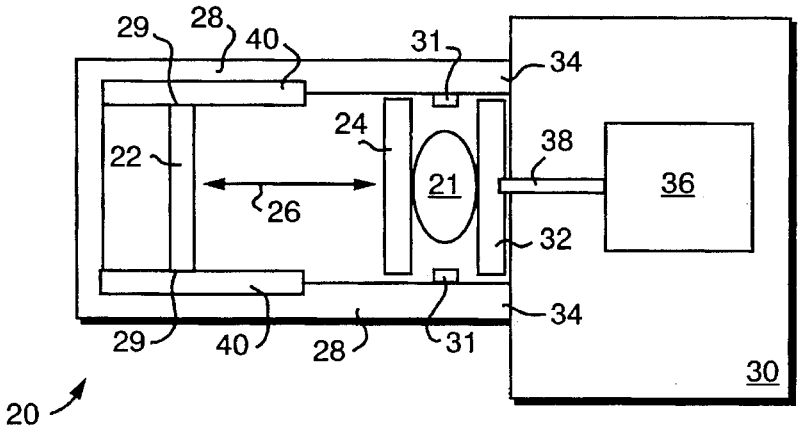
FIG. 2 is a schematic side view of apparatus constructed in accordance with the invention for sharpening a workpiece, such as a razor head.

FIG. 2 illustrates a cut-away side-view of apparatus 20 constructed in accordance with the invention. In one aspect, the apparatus 20 is suitable for sharpening the blades 17 of the rotating razor head 15, illustrated in FIGS. 1B and 1C. In other aspects according to the invention, the apparatus 20 illustrated in FIG. 2 is more generally operable to apply force to a wide range of objects 21.

In FIG. 2, apparatus 20 has a first magnet 22 and a second magnet 24 spaced away from the first magnet 22. The magnets are arranged such that they repel one-another, i.e., such that they have like magnetic poles facing one another, whereby a force 26 is generated that operates to push the magnets 22 and 24 apart. A housing 28 couples the magnets together and fixedly engages the first magnet 22 at engagement points 29. The housing 28 also slideably engages the second magnet 24 so that the second magnet 24 can slideably move within the housing 28 and along the direction associated with the force 26. Preferably, stops 31 or some equivalent are employed with the housing 28 to restrict the second magnet from exiting the housing 28.

The housing 28 couples to a motorized unit 30 having a modifying element 32. The housing 28 couples to the unit 30 so that the second magnet can apply force to the object 21, e.g., the rotating razor head of FIGS. 1B–1C, and push the object 21 against the modifying element 32. The housing 28 is effectively coupled to the motorized unit 30 at connection points 34 by a variety of ways known to those skilled in the art, for example by a latch or other mechanical connector. In one preferred embodiment, the housing 28 and motorized unit 30 are small enough so that the user can hold the housing 28 in one hand and the motorized unit 30 in the other and press the two together at the connection points 34.

In certain aspects of the invention, the motor unit 30 as shown in FIG. 2 is referred to herein as a "support member". That is, the magnet 24 applies force to the object 21 relative to the unit 30.

The motorized unit 30 houses a motor 36 connected to the modifying element 32 via a shaft 38. The motor 36 rotates the shaft 38 within the motorized unit 30 and thereby rotates the modifying element 32. Preferably, the modifying element 32 is a circular stone or grinding element.

The magnets 22 and 24 are separated along the direction of the force 26 by a selected distance. The closer the distance between the magnets, the stronger the force applied to the object 21. Thus the invention includes spacer elements 40 to selectively adjust the force applied to the object 21. The spacer elements 40 are easily constructed by those skilled in the art as static replaceable spacers, screws, or other easily adjustable mechanisms. They allow a user to increase or decrease the force applied to the object 21. By forcing the magnets together, the greatest force is achieved (with a given magnet strength).

In one operation, the spacing between the magnets 22 and 24 is set to a predetermined distance to "fix" the magnitude of the force 26 applied to the object 21. Once the housing 28 is coupled to the motorized unit 30 with the object 21 disposed therebetween, the motor 36 is activated to rotate the modifying element 32. The force 26 applied to the object 21 pushes the object 21 against the modifying element 32 to grind, polish, clean, sharpen, or otherwise modify the object 21 as desired and depending upon the properties of the modifying element 32. Preferably, the modifying element is easily replaceable such that different modifying elements 32 can be used to modify the object 21 with selective qualities.

For example, to sharpen the rotating razor heads 15 discussed in conjunction with FIG. 1–1C, the modifying element is preferably a smooth-grained stone and the object 21 is the rotating razor head 15. The blades 17 are arranged to face the modifying element 32 and the second magnet is large enough to apply substantially uniform force to the entire head 15.

Figure 3:
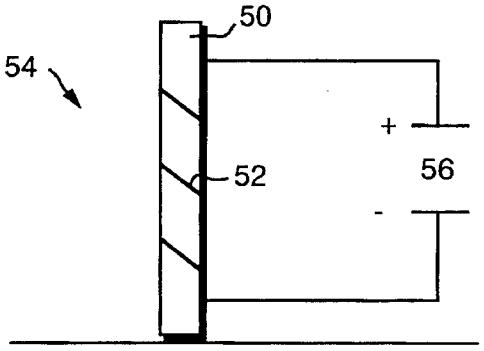
FIG. 3 is a schematic side view of an electromagnet constructed in accordance with the further features of the invention.

In one embodiment according to the invention, one or both of the magnets 22 and 24 are electromagnets. FIG. 3 illustrates that a core 50 made from steel, iron, or mixtures thereof, wound with a solonoidal coil 52 effectively forms an electromagnet 54. A DC current source 56 connected to the coil 52 provides the necessary direct current to activate the electromagnet 54.

Figure 3A:
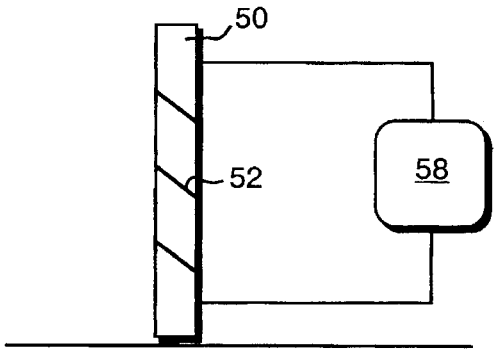
FIG. 3A is a schematic side view of an electromagnet and a DC current controller constructed in accordance with the further features of the invention.

Preferably, the DC current source is a variably driven DC current source 58 (FIG. 3A) that can apply current selectively to the coil 52 at a selected magnitude. By adjusting the current magnitude in the coil 52, the force between the magnets 22 and 24 is selectively adjusted and a wide range of forces can be applied to the object 21 without moving or modifying any components, such as the spacer elements 40. In such embodiment, therefore, the spacer elements 40 simply act to fixedly attach or engage the first magnet to the housing 28.

Figure 4:
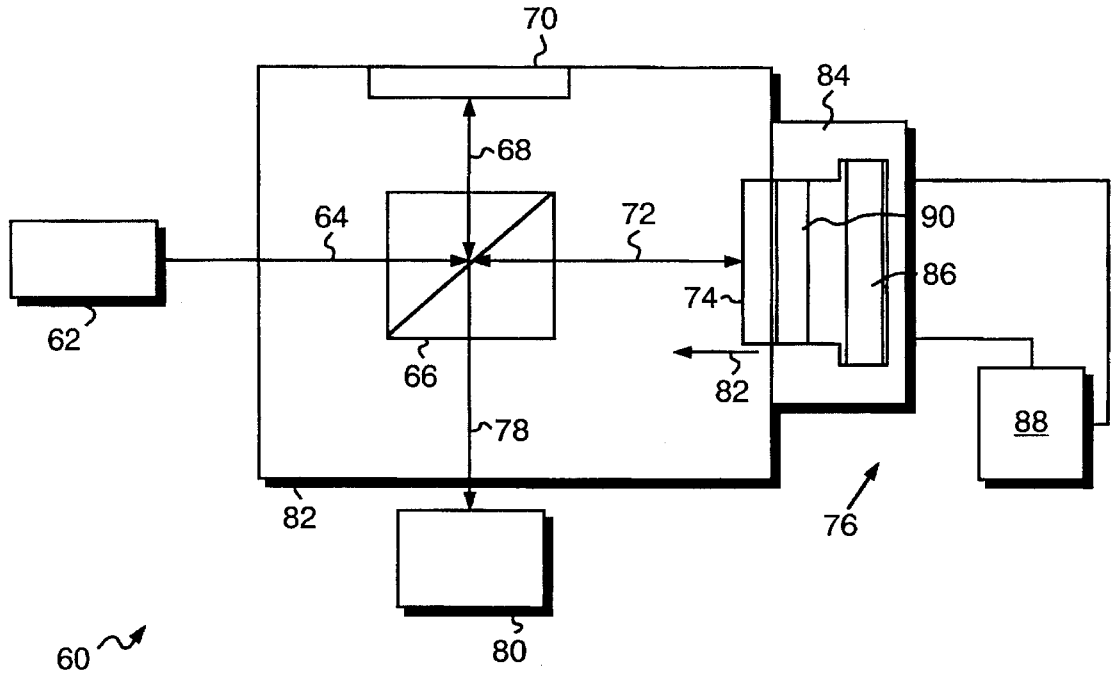
FIG. 4 is an illustration of a fourier transform spectroscopy interferometer incorporating the invention to control movement of an optical mirror.

FIG. 4 illustrates a fourier transform spectrometer in the form of an interferometer 60 which incorporates the features of the invention. In particular, the interferometer 60 has a source 62 which emits a beam of light 64 in a certain wavelength spectrum. The beam 64 enters a beamsplitter 66 and splits into two beams; a first beam 68 is diverted to a first mirror 70; while a second beam 72 is diverted to a second mirror 74 connected to apparatus 76 constructed in accordance with the invention. Both beams 68 and 72 reflect from the respective mirrors 70 and 74 and return to the beamsplitter 66. At the beamsplitter 66 the beams 68 and 72 combine into a combined beam 78 that is detected by a detector 80.

Fourier transform spectroscopy is well-known to those skilled in the art. One known difficulty with these interferometers 60 is the movement of the second mirror 74. Typically, the mirror 74 is connected to an elaborate motor or system which moves the mirror 74 along the axis of the beam 72, i.e., along the direction 83. This motion is necessary to derive the necessary spectroscopy data: i.e., the fourier transform of the detector output as a function of time/position of the mirror 74 provides the spectral information of the source 62.

However, to operate accurately and reliably, the mirror must move accurately and in minute, controlled distances.

The apparatus 76 takes the place of traditional mirror movement controllers by coupling the mirror 74 to apparatus constructed according to the invention, as described above. In particular, the interferometer support structure or member 82 (which supports the components of the interferometer, e.g., a table) is coupled to the housing 84 constructed in accordance with the invention. A first magnet 86 is an electromagnet and is attached or engaged to the housing 84. The first magnet 86 is also connected to a DC current source 88, as described in connection with FIGS. 3 and 3A.

Apparatus 76 includes a second magnet 90, not necessarily an electromagnet and not shown as one, which is slideably engaged with the housing 84. The second magnet 90 is abuttingly coupled to the mirror 74 such that the mirror 74 moves when the magnet moves. By increasing the DC current to the first (electro)magnet 86, the force between the magnet increases and the mirror travels along the direction 83. By coupling a spring (not shown) between the support structure 82 and the mirror 74, a reverse force against the mirror 74 can be generated so that a reduction in current to the first magnet 86 serves to reduce the force between the magnets whereby the spring will push the mirror 74 opposite to the direction 82. Accordingly, by oscillating the current magnitude applied to the first magnet 86, the mirror 74 can be oscillated back and forth along the axis of the beam 72. Alternatively, the second magnet can also be an electromagnet connected to a controllable DC current source such that the forces operating on the mirror 74 are selectively changed with increased sensitivity.

Figure 5:
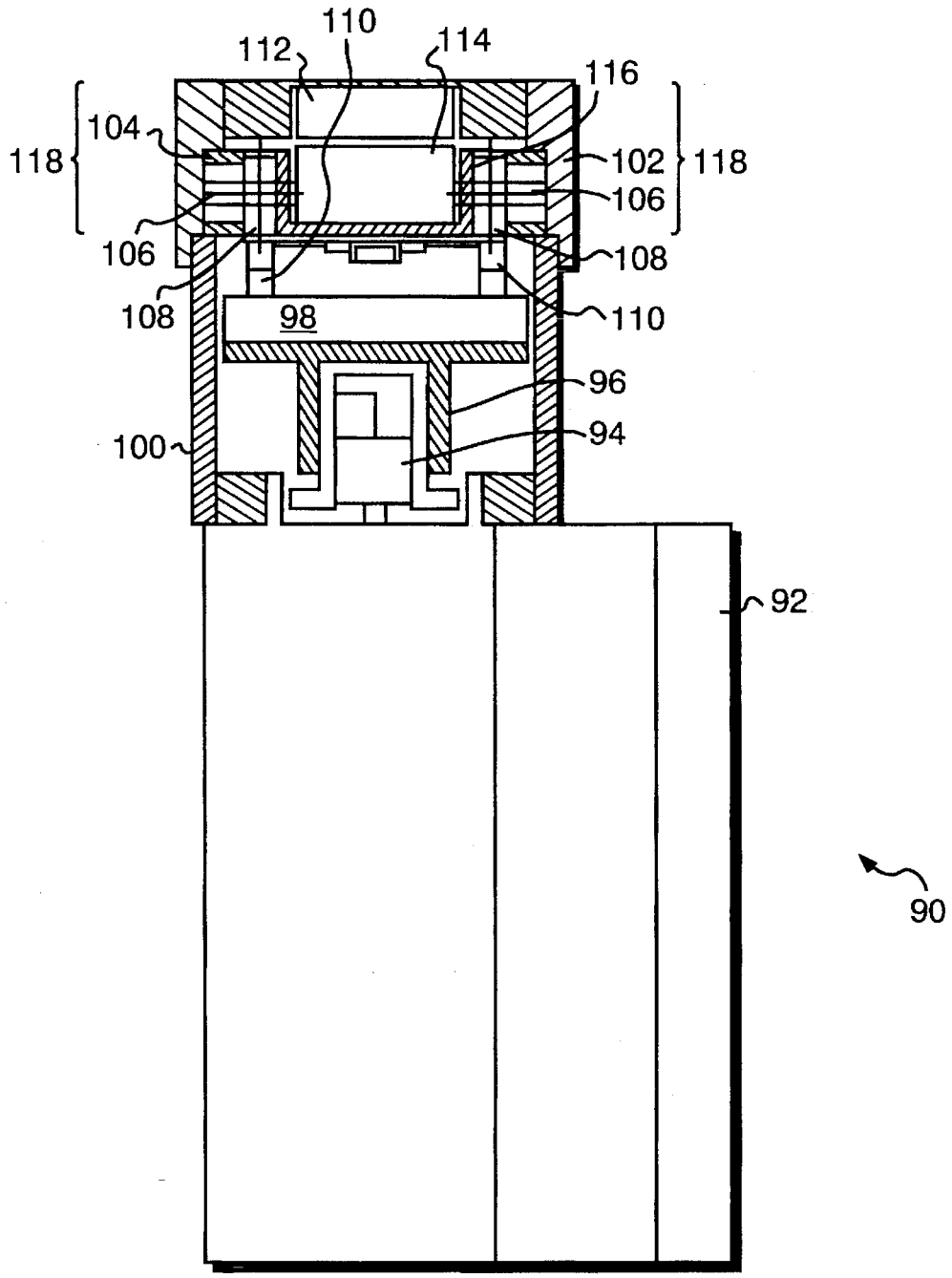
FIG. 5 is a cut-away side view of sharpening apparatus constructed in accordance with the invention for sharpening rotary razor heads used in an electric razor.

FIG. 5 illustrates a razor sharpener 90 for use with rotary head electric razors constructed in accordance with the invention. The sharpener 90 has many components, including: a motorized unit 92, a shaft 94 (unit 92 and shaft 94 are respectively similar to the unit 30 and shaft 38 of FIG. 2), an abrasive disc mount 96, an abrasive disc 98 (e.g., a circular grinding stone or modifying element, such as the modifying element 32 of FIG. 2), a ring adapter 100 and 100A, an outside cap **102*a* and 102*b*, an anti-rotation guide 104, anti-rotation guide pins 106, blade anti-rotation pins 108, blades 110 (i.e., a workpiece similar to the blades 17 illustrated in FIGS. 1B–1C), a first magnet 112, a second magnet 114, and a magnet holder 116**.

The abrasive disk 98 is bonded to the abrasive disc mount 96 which is attached to the motorized unit 92 via the shaft 94. The motorized unit 92 houses a motor which rotates the shaft 94 and thus the abrasive disc 98.

The cap assembly 118 operates to hold the workpiece or object (i.e., the rotating razor head and blades 110) in place and to align the workpiece 110 both radially and in a perpendicular fashion such that the workpiece 110 is square to the rotating abrasive disc 98. Additionally, the cap assembly 118 provides axial loading to the workpiece 110 to force the workpiece 110 against the rotating disc 98, thereby sharpening or otherwise modifying the workpiece 110 with abrasive action when the disc 98 is rotated by the motorized unit 92.

In one embodiment, the cap 102*a* and 102*b* is coupled to the ring adapter 100 and 100A by a user holding the respective components in opposed hands and coupling them together. The cap 102*a* and 102*b* seats onto the ring adapter 100 and 100A which is directly coupled or attached to the motorized unit 92.

The axial force applied to the workpiece 110 is caused by two magnets 112 and 114 within the cap assembly 118. The magnets 112 and 114 perform two separate functions: first magnet 114 holds the workpiece 110 in place with a magnetic attraction; and secondly, they provide an opposing force which is used to axially load the workpiece 110 against the rotating disc 98. The opposing force is created when the magnets 112 and 114 are arranged in a north-north or south-south magnetic orientation. The first magnet 112 is stationary, being secured to the outside cap 102. The second magnet 114 is slideably moveable within the cap assembly 118, and in particular within the anti-rotation guide 104. Thus, the second magnet 114 can move axially along the direction of the opposed force between the magnets; but it cannot rotate. The magnet holder 116 houses the second magnet 114 in a non-rotational manner and has a plurality of anti-rotation guide pins 106 which extend from the magnet holder 116 and through the anti-rotation guide 104.

The anti-rotational guide 104 is also easily constructed by those skilled in the art by making the guide a non-circular element. By making the outer housing element or housing cap 102 the same non-circular shape, the anti-rotational guide will not rotate within the housing. In such a construction, the magnet 114 is also formed in the same non-circular shape so it to does not rotate within the anti-rotation guide.

Anti-rotation mechanisms are also necessary with respect to the blade or workpiece 110 to resist rotational forces received when it comes into contact with the abrasive disc 98. The magnet holder 116 accomplishes this by employing three dowel anti-rotation guide pins 108 arranged such that the pins 108 "catch" or secure the workpiece 110 from rotation. The pins 108 extend into the magnet holder 116 and thus are likewise non-rotational.

More particularly, the workpiece is coupled to the magnet 114 by magnetic attraction and is prevented from rotating when in contact with the abrasive disc by the pins 108. To restrict the rotation of the combination comprising the workpiece 110 and the magnet 114, two radially projecting anti-rotational guide pins 106 press into the magnet holder 116 in a manner wherein the pins 106 are perpendicular to the rotation axis of the abrasive disc 98. Pins 106 ride in slots in the anti-rotation guide 104 which allow the workpiece 110 to move axially. Radial restriction is accomplished by the anti-rotation guide 104 which is bonded into the cap assembly 118 after combining the magnet holder 116 and the associated pins 106 and 108.

Figure 6:
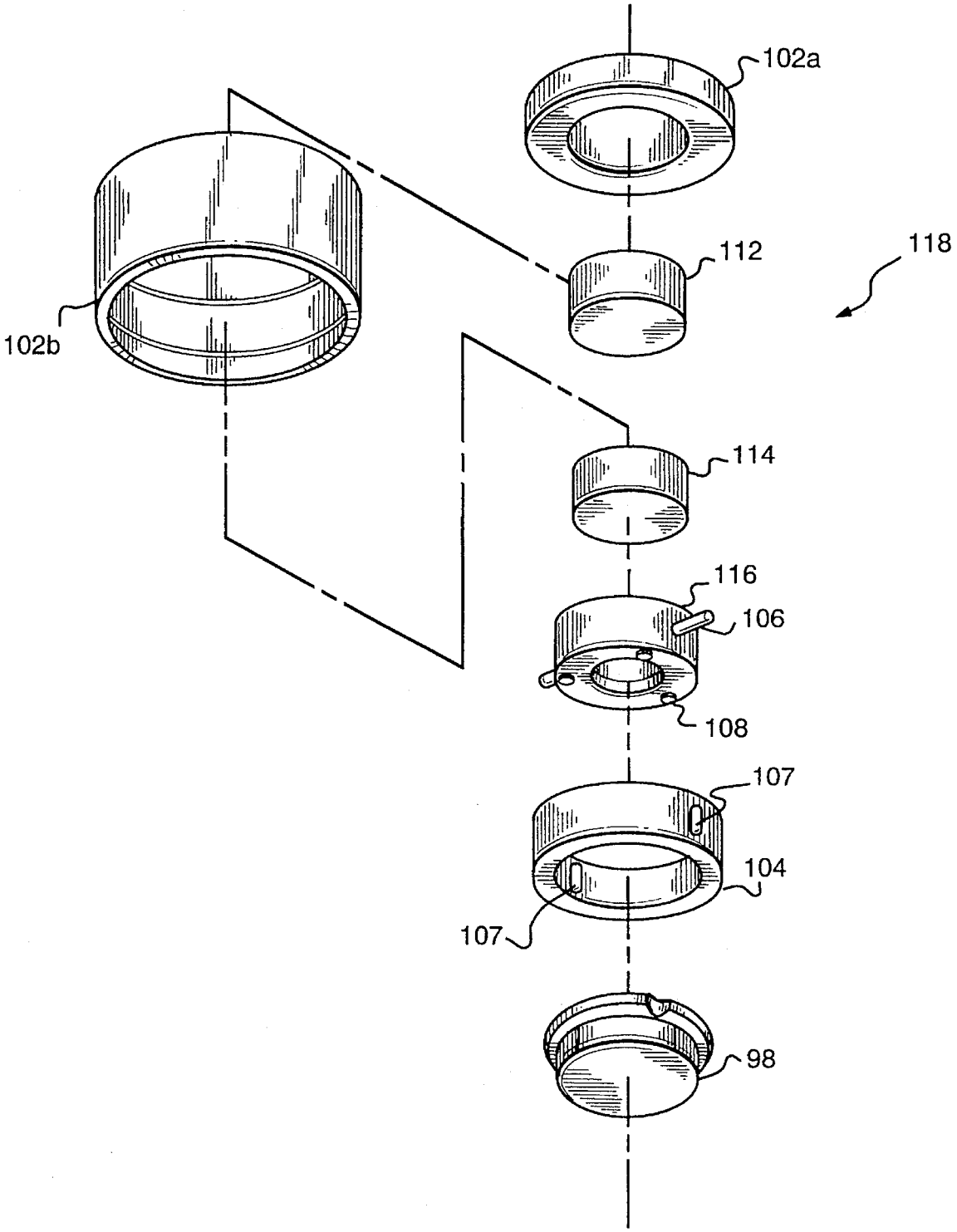
FIG. 6 is an exploded perspective view of the cap assembly and workpiece shown in FIG. 5.

FIG. 6 illustrates the cap assembly 118 and the workpiece or blade 98 in an exploded perspective view. The first magnet 112 is stationary within the outside cap 102 (shown here as two components 102*a* and 102*b* which are bonded together to form the complete cap 102). The second magnet 114 is bonded within the blade holder 116. The anti-rotation guide 104 slides over the blade holder 116 and operates to prevent rotation of the blade holder 116 within the anti-rotation guide 106. Anti-rotation guide pins 106 extend into the blade holder 116 and into a slotted guide 107 in the wall of the anti-rotation guide 104 to prevent rotation of the blade holder and yet to permit the axial movement of the second magnet 114. Three blade anti-rotation pins 108 also extend into the magnet holder 116 and act to "catch" the workpiece 98 such that the workpiece 98 does not rotate.

Figure 7:
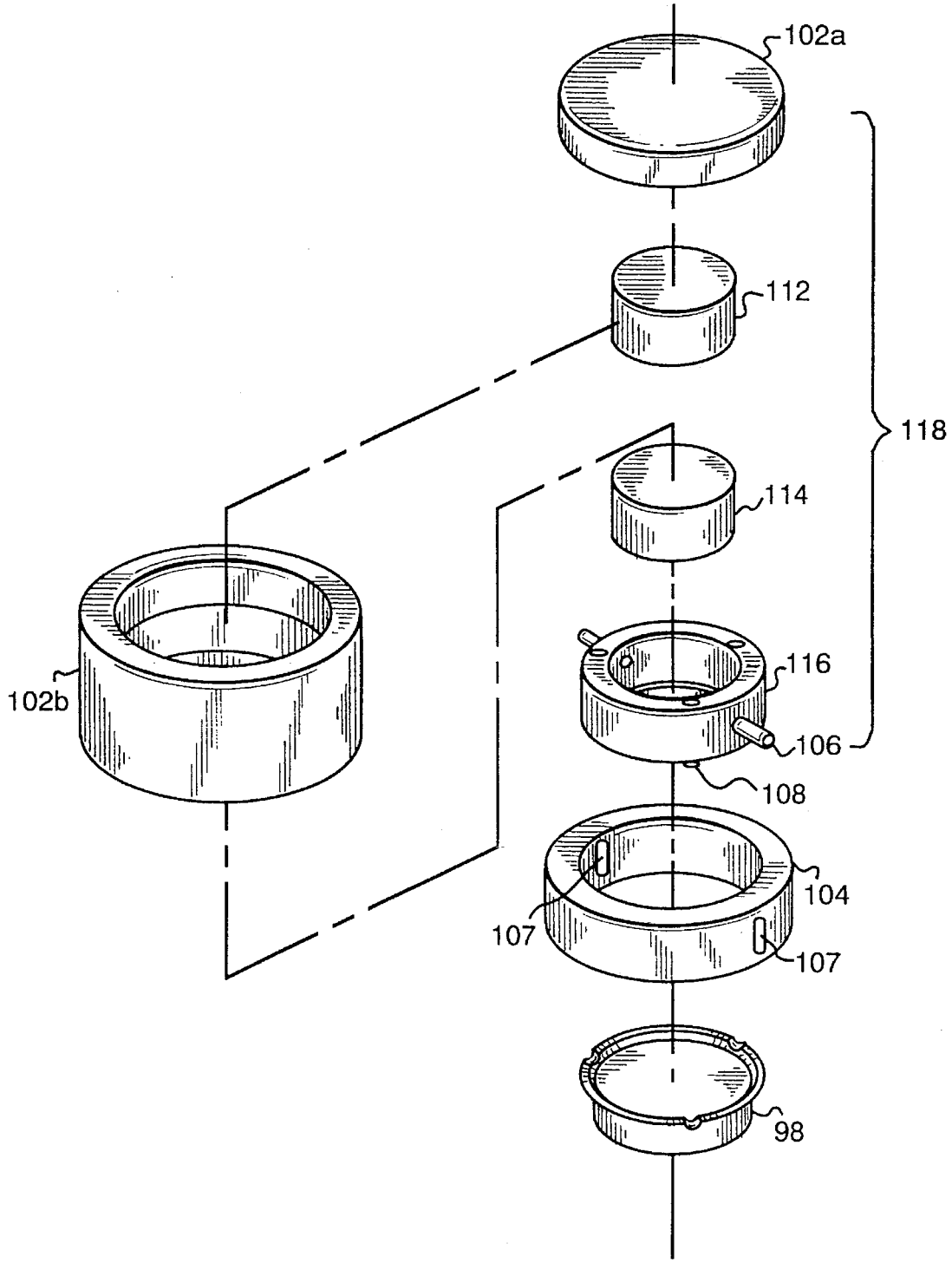
FIG. 7 is another exploded perspective view of the cap assembly and workpiece shown in FIG. 5.
Figure 8:
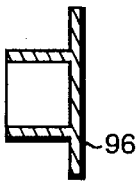
FIG. 8 is a cut-away side view of the abrasive disc mount of the apparatus shown in FIG. 5.
Figure 9:
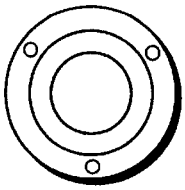
FIG. 9 is a top view of the magnet holder of the apparatus shown in FIG. 5.
Figure 9A:
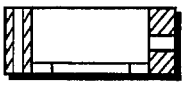
FIG. 9A is an cut-away side view of the magnet holder of FIG. 9.
Figure 9B:
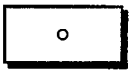
FIG. 9B is a side view of the magnet holder of FIG. 9A.
Figure 10:
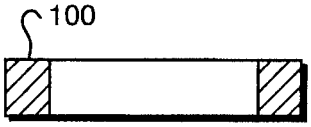
FIG. 10 is an cut-away side view of part of the ring adapter illustrated in FIG. 5.
Figure 11:
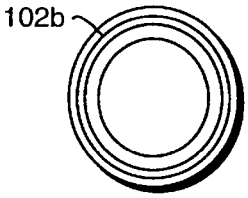
FIG. 11 is a top view of part of the outside cap illustrated in FIGS. 5–7.
Figure 11A:
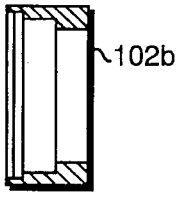
FIG. 11A is an cut-away side view of the cap illustrated in FIG. 11.
Figure 12:
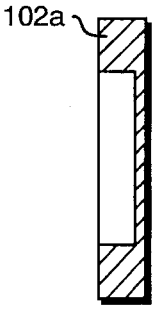
FIG. 12 is an cut-away side view of part of the cap illustrated in FIGS. 5–7.
Figure 13:
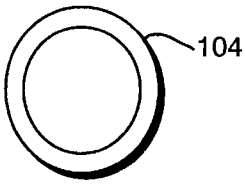
FIG. 13 is a top view of the anti-rotation guide illustrated in FIGS. 5–7.
Figure 13A:
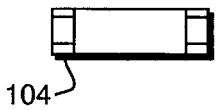
FIG. 13A is a cut-away side view of the anti-rotation guide illustrated in FIG. 13.
Figure 13B:
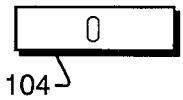
FIG. 13B is a side view of the anti-rotation guide illustrated in FIG. 13.

FIG. 7, similar to FIG. 6, illustrates another exploded perspective view of the cap assembly 118 and the workpiece 98. The illustrated components have like numerals. FIG. 8 illustrates the disc mount 96 illustrated in FIG. 5. FIGS. 9–9 B illustrate different views of the magnet holder 116 shown in FIGS. 5–7. FIGS. 10 and 10A illustrate in cut-away side views the ring adapter 100 and 100A shown in FIG. 5. FIGS. 11 and 11A illustrate different views of part of the outside cap 102b shown in FIGS. 5, 6–7. FIG. 12 illustrates in a cut-away side view part of the cap 102*a* shown in FIGS. 5, 6–7. FIG. 13–13B illustrates three views of the anti-rotation guide 104 illustrated in FIGS. 5–7

It is to understood that the apparatus described in connection with FIGS. 2–13 are illustrative rather than limiting, and that additions and modifications will be apparent to those skilled in the art and which fall within the scope of the claims which follow.

In view of the foregoing, what is claimed as new and secured by the Letters Patent is:

1. A razor sharpener for sharpening a rotary razor head, comprising a housing member, a first magnet held stationary within said housing member, a second magnet slideably engaged with said housing member and arranged such that said second magnet is repelled from said first magnet in at least one direction, said second magnet being slideably engaged with said housing member along said one direction, and motor means, coupled to said housing member, having a motor and abrasion means adjacent to said second magnet, said motor driving said abrasion means to sharpen a rotary razor head forced against said abrasion means, said second magnet being spaced apart to accommodate the rotary razor head therebetween wherein said second magnet forces the rotary razor head against said abrasion means.

2. A razor sharpener according to claim 1, further comprising first anti-rotation guide means for preventing the rotation of said second magnet relative to said housing member.

3. A razor sharpener according to claim 2 wherein said anti-rotational guide means comprises a magnet holder having at least one anti-rotational pin member, said anti-rotational guide being arranged with at least one slot wherein said pin member extends into said slot and prevents said second magnet from rotating.

4. A razor sharpener according to claim 3 wherein said magnet holder further comprises at least one anti-rotation razor head pin extending away from said magnet holder such that the rotary razor head is prevented from rotation when forced into said abrasion means by said second magnet.

5. A razor sharpener according to claim 2 wherein said housing member comprises an outside cap for enclosing said magnets and said anti-rotational guide means.

6. A razor sharpener according to claim 1, further comprising a rotary razor head having a plurality of blades, and wherein said abrasion means and said second magnet have sufficient size to accommodate said razor head such that said razor head is sharpened substantially equally when forced into said abrasion means by said second magnet.

* * * * *